US008117951B2

(12) United States Patent
Brobst

(10) Patent No.: US 8,117,951 B2
(45) Date of Patent: Feb. 21, 2012

(54) DOUBLE FLEX WRENCH

(75) Inventor: Thomas J. Brobst, Allentown, PA (US)

(73) Assignee: Accu-Sort Systems, Inc., Telford, PA (US)

( * ) Notice: Subject to any disclaimer, the term of this patent is extended or adjusted under 35 U.S.C. 154(b) by 277 days.

(21) Appl. No.: 12/355,221

(22) Filed: Jan. 16, 2009

(65) Prior Publication Data

US 2010/0180733 A1 Jul. 22, 2010

(51) Int. Cl.
*B25B 23/16* (2006.01)

(52) U.S. Cl. ..... 81/177.8; 81/177.2; 81/73

(58) Field of Classification Search ..... 81/177.7–177.9, 81/73, 28–37, 177.2
See application file for complete search history.

(56) References Cited

U.S. PATENT DOCUMENTS 3,375,860 A * 4/1968 Vosbikian et al. ..... 81/30
4,334,445 A * 6/1982 Timewell ..... 81/177.7
6,857,341 B1 * 2/2005 Cheng ..... 81/177.8

* cited by examiner

*Primary Examiner* — Debra S Meislin
(74) *Attorney, Agent, or Firm* — Nelson Mullins Riley & Scarborough, LLP

(57) ABSTRACT

A wrench having a main body defines a first end, an opposite second end, and an axis extending therebetween. A handle body defines a first end, an opposite second end, and an axis extending therebetween, wherein the handle body first end is pivotally coupled to the main body second end. A handle is axially fixed and rotatably coupled to the handle body second end. A tang, having a first end configured to releasably receive a tool, an opposite second end, and an axis extending therebetween, is pivotally coupled to the main body first end. A detent is received in a recesses defined in one of the handle body first end and the main body second end.

10 Claims, 11 Drawing Sheets

DOUBLE FLEX WRENCH

FIELD OF THE INVENTION

The present invention relates generally to wrenches. More particularly, the present invention relates to a wrench having two pivoting joints.

BACKGROUND OF THE INVENTION

Often, fasteners used to assemble structures require multiple tools depending on the location, angle and type of fastener. In the case of preassembled fasteners, the user must turn the nut multiple times requiring the wrench to be engaged and disengaged from the fastener. Obstacles that block rotation of the tool being used when in tight spaces also cause such repetitive action.

The present invention recognizes and addresses the foregoing disadvantages, and others, of prior art constructions and methods.

SUMMARY OF THE INVENTION

The present invention provides a wrench for engaging a workpiece. The wrench comprises a main body having a first end, an opposite second end, and an axis extending therebetween. A handle body has a first end, an opposite second end, and an axis extending therebetween, where the handle body first end is pivotally coupled to the main body second end. A handle is axially fixed and rotatably coupled to the handle body second end. A tang having a first end configured to releasably receive a tool, an opposite second end and an axis extending therebetween, is pivotally coupled to the main body first end.

In some embodiments, the handle body first end defines one of a first yoke and a first hub and the main body second end defines the other of the first yoke and the first hub. The first yoke and the first hub are rotatably coupled to each other by a fastener thereby forming a first pivot. In these embodiments, the wrench main body first end defines one of a second yoke and a second hub, the tang second end defines the other of the second yoke and the second hub, and the second yoke and the second hub are rotatably coupled to each other by a fastener thereby forming a second pivot.

In other embodiments, the handle pivots with respect to the main body on a common plane to the handle body axis and the main body axis, and the tang pivots with respect to the main body so that the tang axis moves on the common plane.

In other embodiments, the handle is axially fixed and rotatably received on the handle body second end by a fastener. In these embodiments, the fastener can be any suitable fastener such as a pin and a cap nut that is press fitted to one end of the pin.

In yet other embodiments, the wrench further comprises a first detent positioned intermediate the handle body first end and the main body second end. The first detent may comprise a first spring and a first pin. In other embodiments, the first detent may comprise a flat spring.

In other embodiments, the wrench further comprises a second detent positioned intermediate the main body first end and the tang second end. The second detent may comprise a second spring and a second pin.

In another embodiment, a wrench having a main body defines a first end, an opposite second end, and an axis extending therebetween. A handle body defines a first end, an opposite second end, and an axis extending therebetween, wherein the handle body first end is pivotally coupled to the main body second end. A handle is axially fixed and rotatably coupled to the handle body second end. A tang, having a first end configured to releasably receive a tool, an opposite second end, and an axis extending therebetween, is pivotally coupled to the main body first end. A detent is received in a recess defined in one of the handle body first end and the main body second end.

In yet another embodiment, a wrench comprises a main body having a longitudinal axis. A handle body has a longitudinal axis, wherein the handle body is pivotally coupled to the main body. A handle is axially fixed and rotatably coupled to the handle body. A tang having a longitudinal axis is pivotally coupled to the main body. The handle body longitudinal axis, the main body longitudinal axis and the tang longitudinal axis are all positioned on a common plane and are maintained on the common plane as each is pivoted with respect to the others.

Other objects, features and aspects of the present invention are provided by various combinations and subcombinations of the disclosed elements, as well as methods of utilizing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
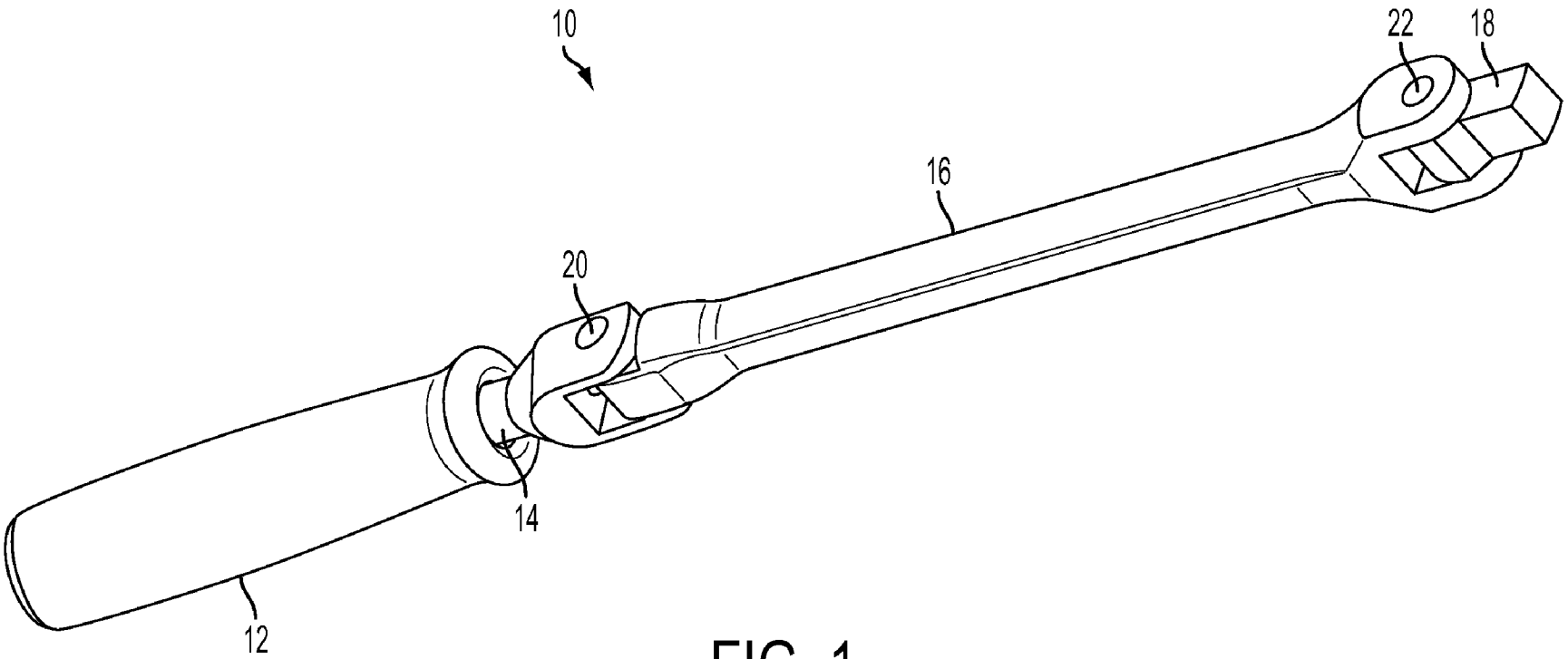
FIG. 1 is a perspective view of a preferred embodiment of a two pivot wrench in accordance with the present invention.

Repeat use of reference characters in the present specification and drawings is intended to represent same or analogous features or elements of the invention according to the disclosure.

DETAILED DESCRIPTION OF THE PREFERRED EMBODIMENT

Reference will now be made in detail to presently preferred embodiments of the invention, one or more examples of which are illustrated in the accompanying drawings. Each example is provided by way of explanation, not limitation, of the invention. It is to be understood by one of ordinary skill in the art that the present discussion is a description of exemplary embodiments only, and is not intended as limiting the broader aspects of the present invention, which broader aspects are embodied in the exemplary constructions. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
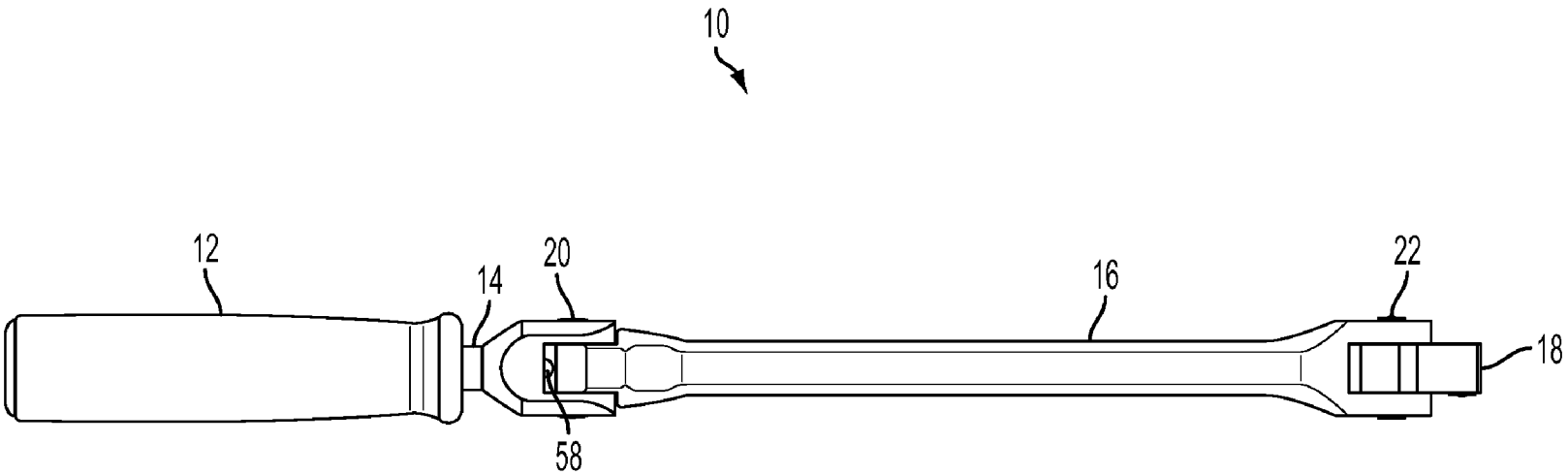
FIG. 2 is a top view of the two pivot wrench as shown in FIG. 1.
Figure 3:
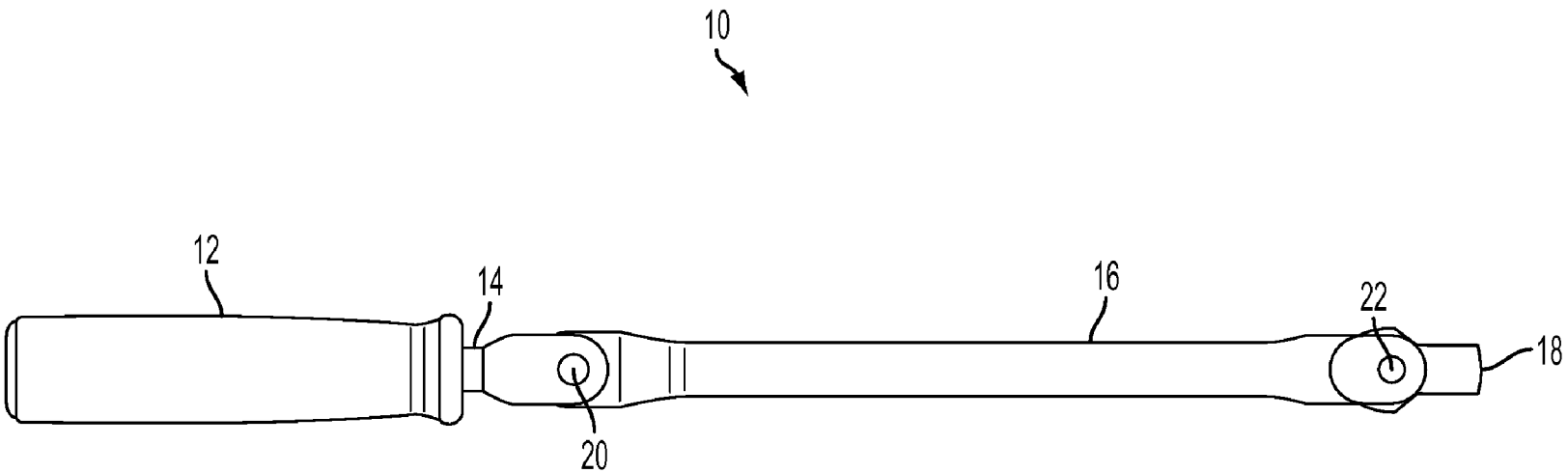
FIG. 3 is a side view of the two pivot wrench as shown in FIG. 1.
Figure 4:
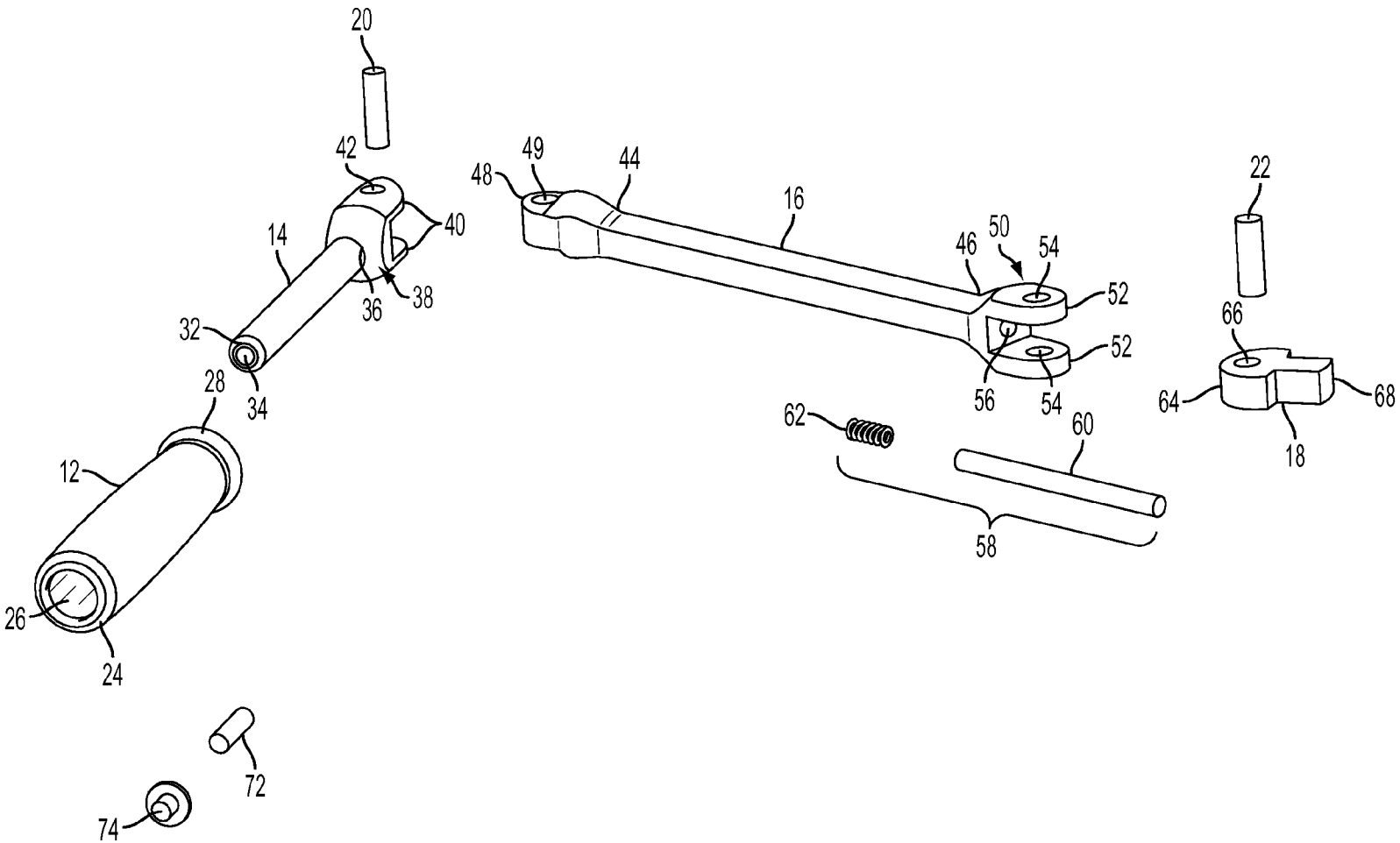
FIG. 4 is an exploded perspective view of the two pivot wrench shown in FIG. 1.
Figure 5:
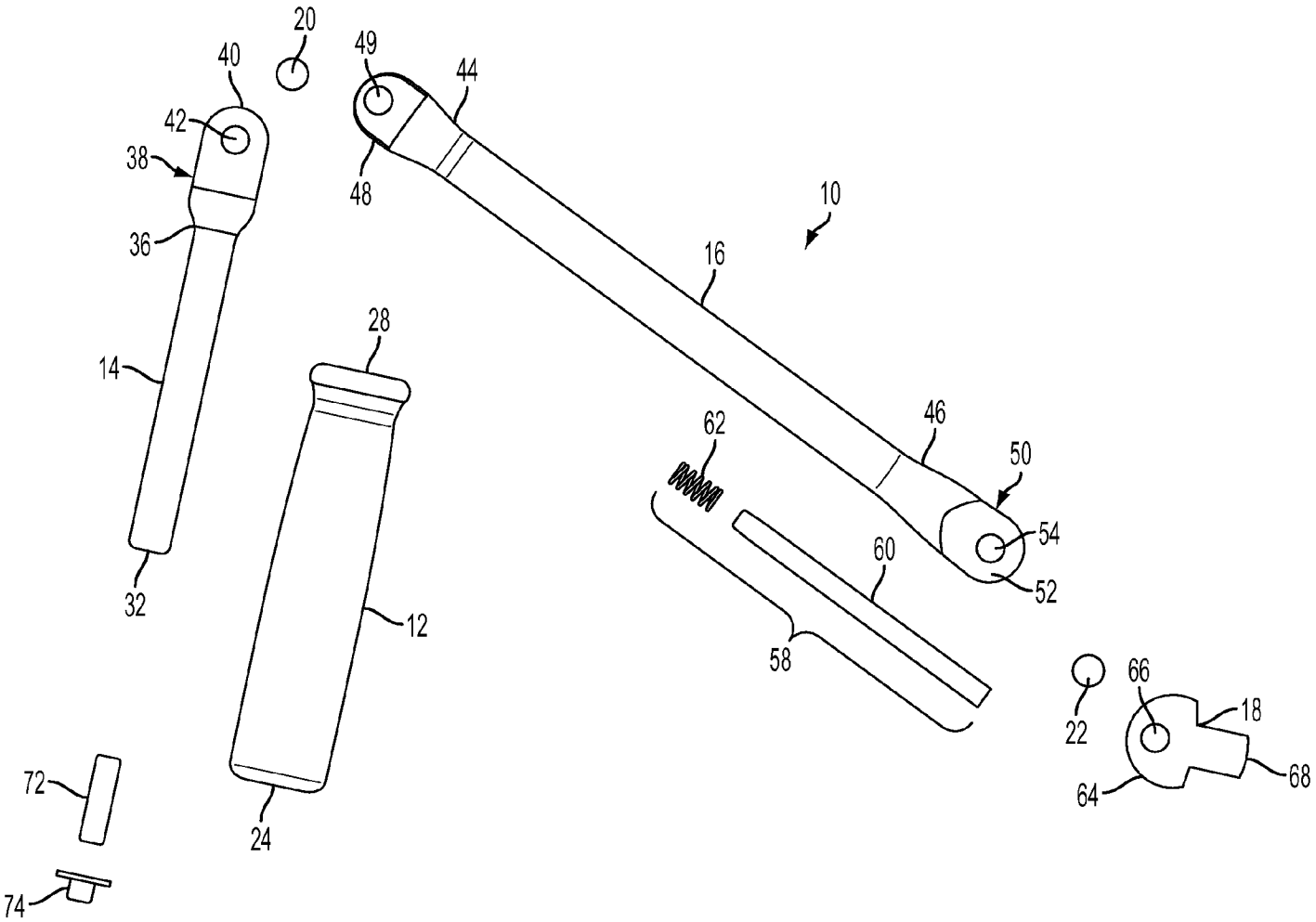
FIG. 5 is an exploded side view of the two pivot wrench shown in FIG. 1.

Referring to FIGS. 1-3, a two pivot wrench 10 has a handle 12, a handle body 14, a main body 16 and a drive tang 18. A pin 20 pivotally couples handle body 14 to main body 16, and a pin 22 pivotally coupled drive tang 18 to main body 16. Referring to FIGS. 4-5, handle 12 has a first end 24 that defines a bore 26 formed therein, and a second end 28 that also defines a bore 30 (FIG. 6) therein. Handle body 14 has a first end 32 that defines a blind bore 34 therein, and a second end 36 that defines a first yoke 38. Yoke 38 is formed from two opposing flanges 40 each defining a bore 42 therethrough, which are configured to receive pin 20.

Main body 16 has a first end 44 and a second end 46. First end 44 defines a hub 48 that is received in handle body yoke 38. Hub 48 defines a bore 49 therethrough that also receives pin 20. Hub 48 is sized and shaped to fit intermediate body second end yoke flanges 40 so that pin 20 is received in bores 42 and bore 49. The hub and yoke connection provide a pivot joint between the handle body and the main body first end that allows an axis of the handle body (not numbered) to be moved with respect to an axis of main body 16.

Main body second end 46 defines a second yoke 50 having two opposing flanges 52. Each flange 52 defines a bore 54 therethrough. Second end 46 also defines an axial bore 56 (FIG. 4) configured to receive a spring loaded detent 58. Detent 58 may be any suitable camming device, and in one preferred embodiment detent 58 comprises an elongated pin 60 and spring 62. In operation, detent 58 biases drive tang 18 so that an axis of second end 68 is colinear with an axis of main body 16.

Tang 18 has a first end hub 64 that is rotatably received intermediate second yoke flanges 52. Tang first end hub 64 defines a through bore 66 that aligns with yoke flange bores 54 so that pin 22 rotatably secures the tang first end hub to the yoke. Detent 58 engages tang first end hub 64 to prevent it from freely moving without resistance. That is, detent 58 exerts resistance against tang first end hub 64 so that the hub is maintained in a position set by the user. A second end 68 defines a square cross-section that is releasably received in a socket or other working tool.

Figure 6:
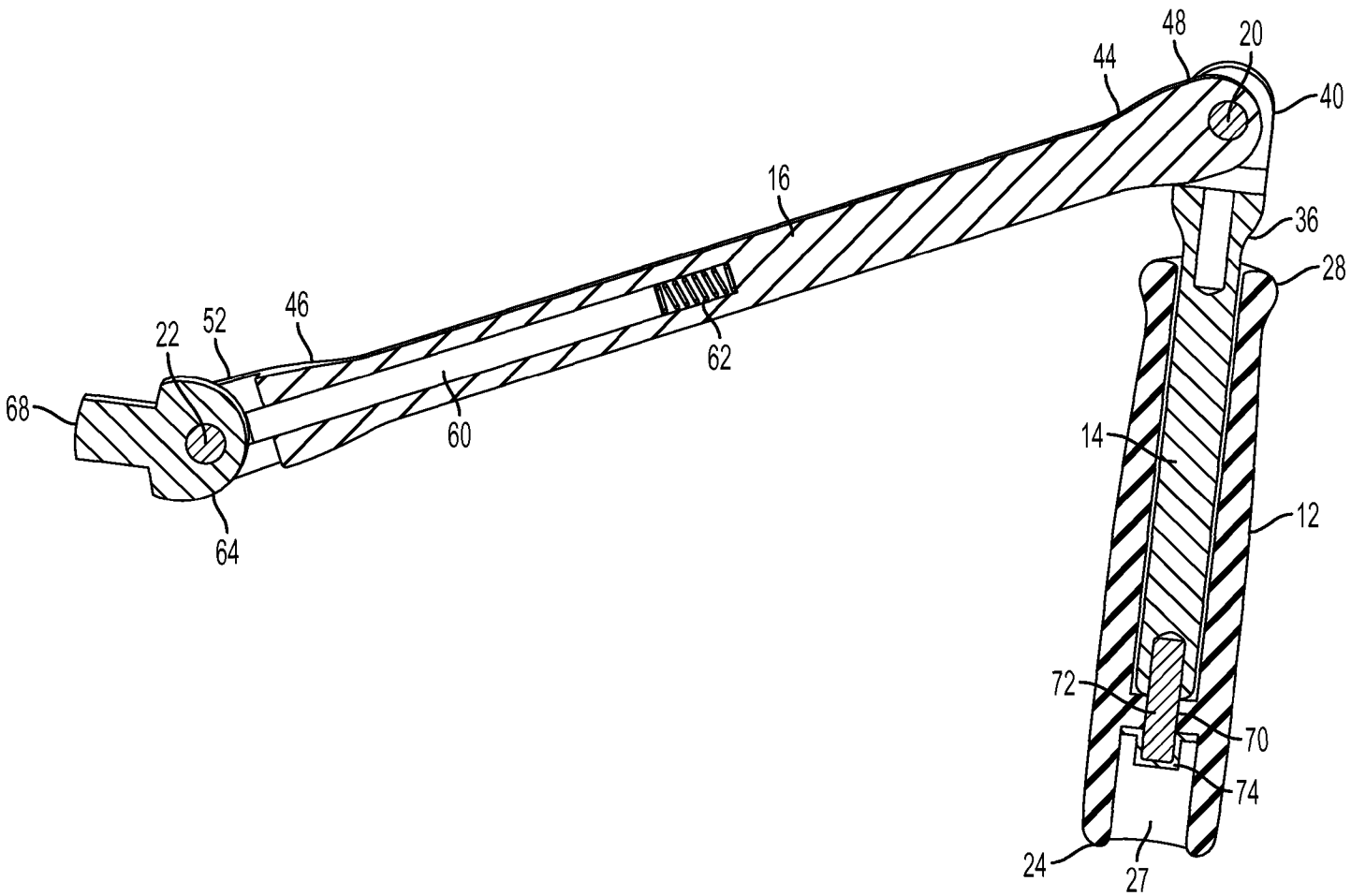
FIG. 6 is a side sectional view of the two pivot wrench of FIG. 1.

Referring to FIG. 6, handle body first end 32 is rotatably received in handle second end bore 26 so that handle body first end bore 34 aligns with a through hole 70. In this position, a pin 72 is press fit into handle body first end bore 34 and a cap nut 74 is press-fitted onto an opposite end of pin 72 in a handle bore 27. The pin and cap nut connection allow handle 12 to rotate with respect to handle body 14.

In operation, handle 12 may be pivoted with respect to main body 16 so that handle body 14 is perpendicular to main body 16. In addition, tang 18 may also be pivoted with respect to main body 16 so that square tang second end 68 is perpendicular to main body 16. This configuration allows the tool to be used as a crank since handle 12 rotates with respect to handle body 14. If tang second end 68 is left parallel to the axis of main body 16, then the tool is in a wrench position. Finally, if the pivot points are in a position between parallel and perpendicular, the tool is in a swivel driver position.

Figure 7:
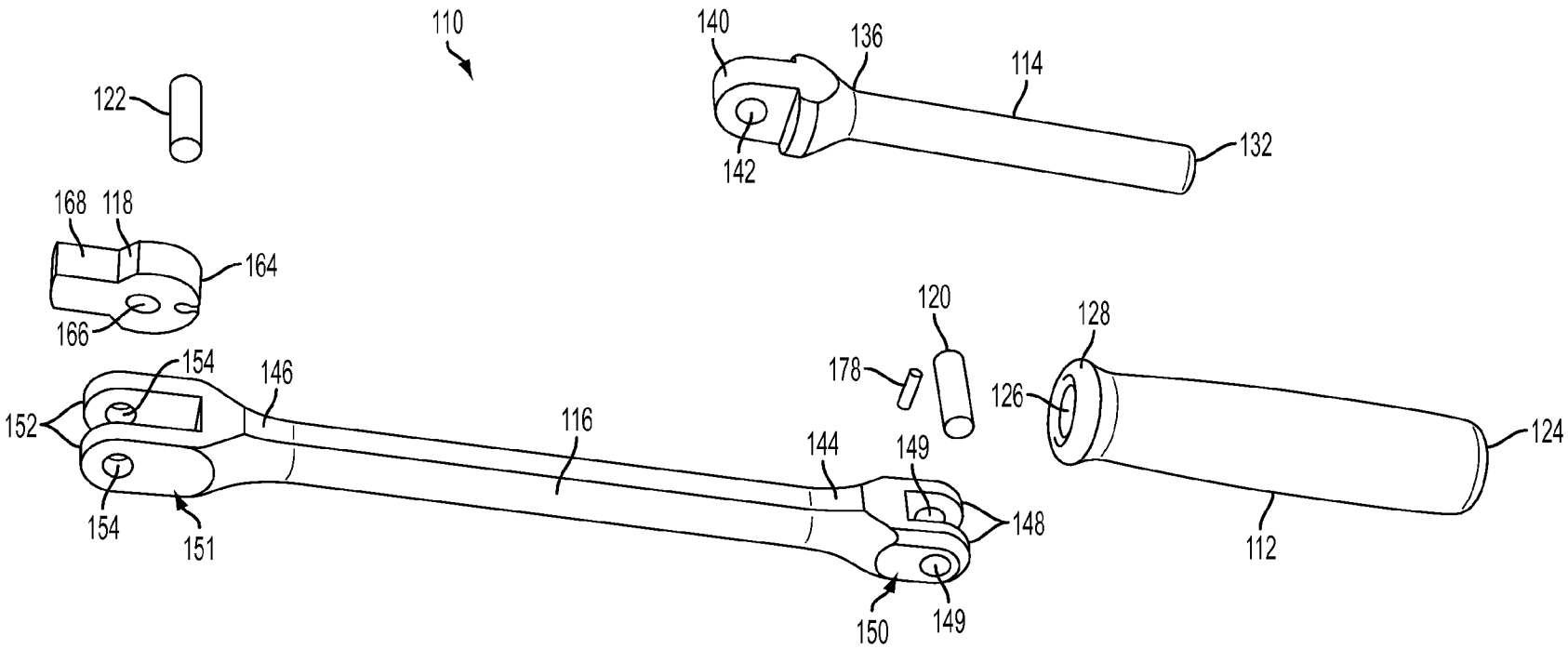
FIG. 7 is an exploded perspective view of a preferred embodiment of a two pivot wrench in accordance with the present invention.

Referring to FIG. 7, in another preferred embodiment, a tool 110 has a handle 112 having a first end 124 and a second end 128 that defines a bore 126 therein. A handle body 114 has a first end 132 and an opposite second end 136. Handle body second end 136 defines a hub 140 that defines a through-hole 142.

Figure 8:
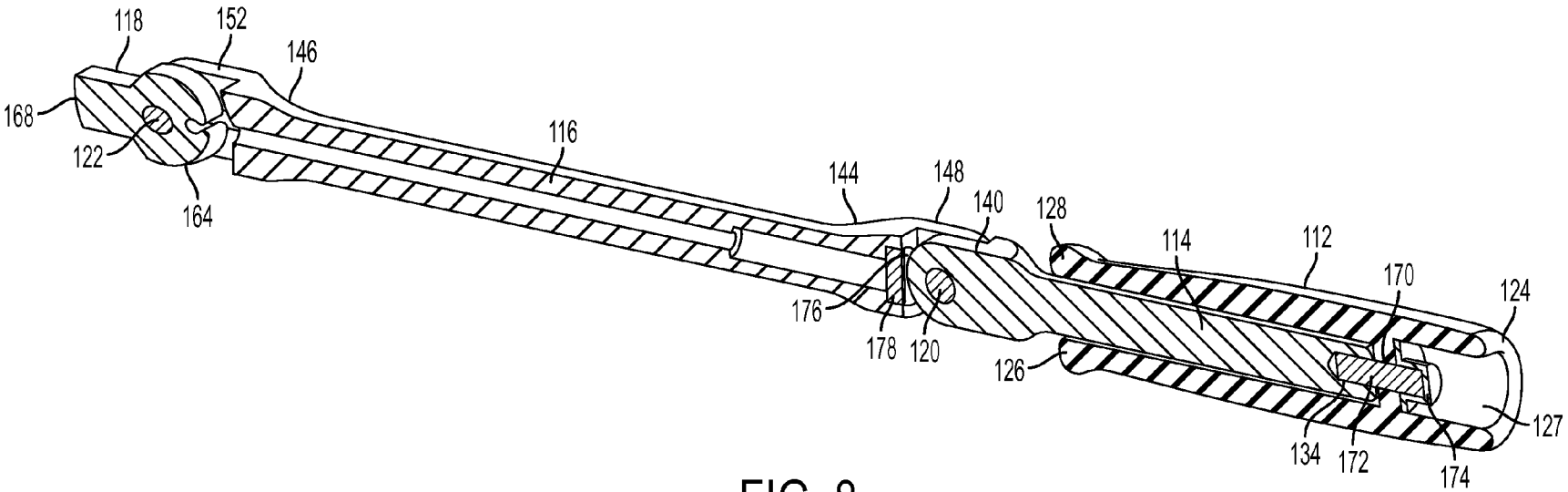
FIG. 8 is a side sectional view of the two pivot wrench of FIG. 7.

A main body 116 has a first end 144 that defines a first yoke 150, and a second end 146 that defines a second yoke 151. First yoke 150 has two opposing flanges 148 each defining a through-hole 149. First yoke flanges 148 rotatably receive handle second end hub 140 so that hub hole 142 aligns with yoke flange holes 149. A pin 120 is received in holes 142 and 149 to form a rotatable pivot joint. A pin 178 is removably received in an axial recess 176 (FIG. 8). An elongated elastic member (not shown) may be coupled at one end around pin 178 and at the opposite end to a recess formed in a tang first end 164. In this configuration, the elongated elastic member biases tang 18 into the position shown in FIG. 8.

Main body second end yoke 151 has two opposing flanges 152 each defining a through-hole 154. A tang 118 has first end hub 164 that defines a through-hole 166 and a second square end 168. Tang first end hub 164 is rotatably received between second yoke flanges 152 so that second flange through-holes 154 align with tang first end hub through-hole 166. A pin 122 is received in the through-holes to form a second pivot joint. Referring to FIG. 8, handle 112 is rotatably coupled to handle body first end similar to that described above with respect to the embodiment shown in FIGS. 1-6.

Figure 9:
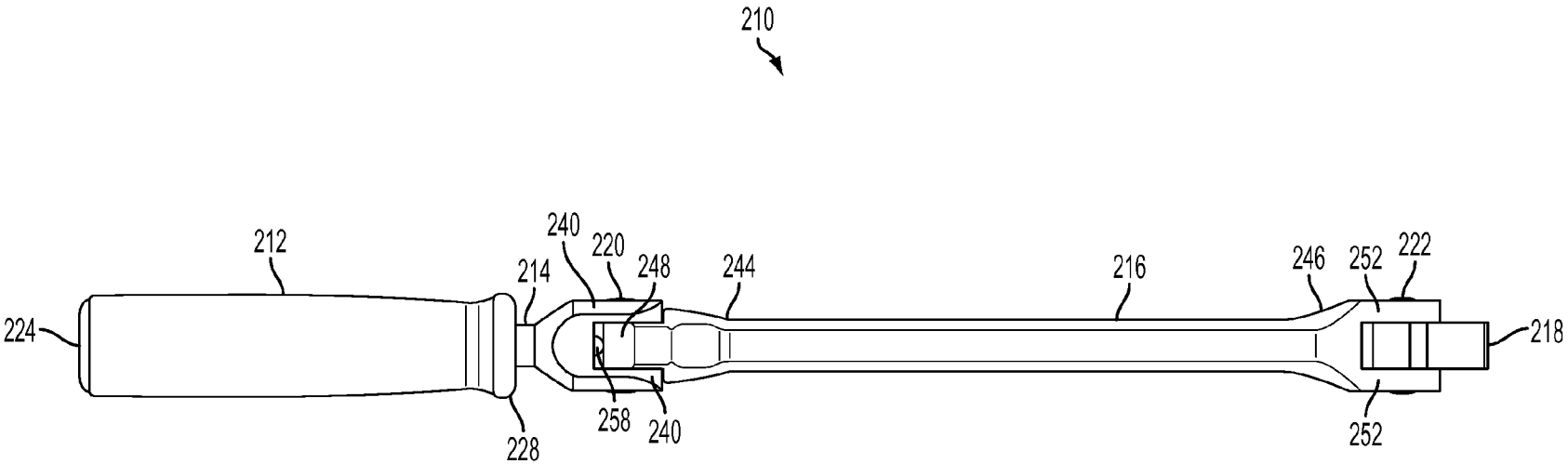
FIG. 9 is a perspective view of a preferred embodiment of a two pivot wrench in accordance with the present invention.
Figure 10:
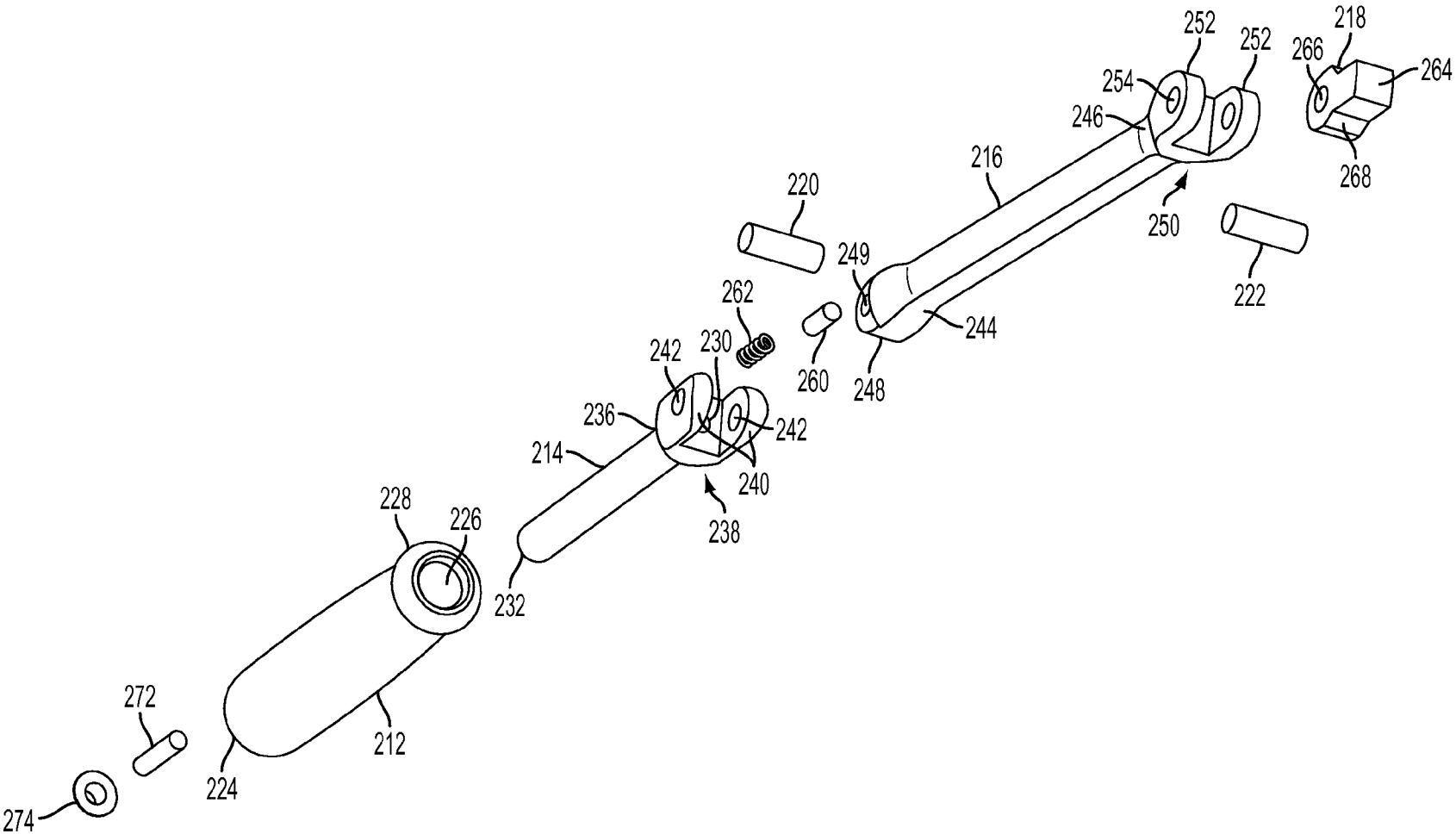
FIG. 10 is an exploded perspective view of the two pivot wrench of FIG. 9.

In yet another embodiment shown in FIGS. 9 and 10, a tool 210 has a handle 212 having a first end 224 and a second end 228 that defines a bore 226 (FIG. 10) therein. A handle body 214 has a first end 232 and an opposite second end 236. Handle body second end 236 defines a yoke 238 having two opposing flanges 240 each defining a through-hole 242. An axial bore 230 is formed in handle body second end 236.

A main body 216 has a first end 244 that defines a hub 248, and a second end 246 that defines a yoke 250. Handle body second end yoke flanges 240 rotatably receive main body first end hub 248 so that hub hole 249 aligns with yoke flange holes 242. A pin 220 is received in holes 242 and 249 to form a rotatable pivot joint. Main body second end yoke 250 has two opposing flanges 252 each defining a through-hole 254. A tang 218 has a first end hub 264 that defines a through-hole 266 and a second square end 268. Tang first end hub 264 is rotatably received between main body second end yoke flanges 252 so that second end yoke flange through-holes 254 align with tang first end hub through-hole 266. A pin 222 is received in the through-holes to form a second pivot joint.

Figure 11:
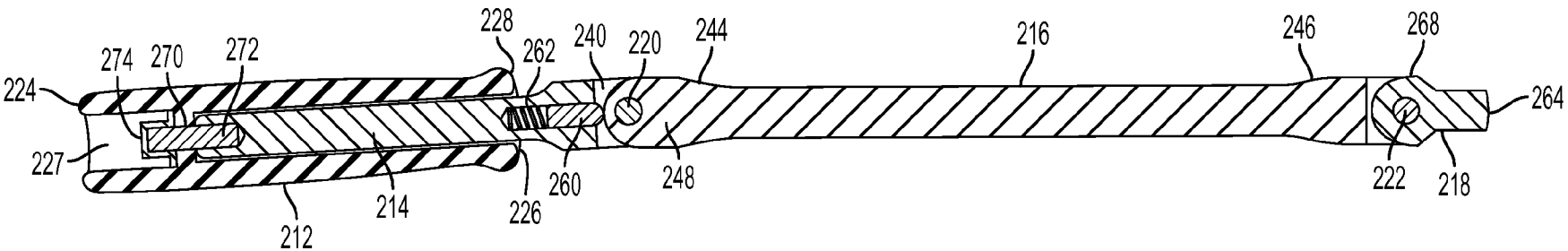
FIG. 11 is a side sectional view of the two pivot wrench of FIG. 9.

Referring to FIG. 11, handle 212 is rotatably coupled to handle body first end similar to that described above with respect to the embodiment shown in FIGS. 1-6. A detent 258 (FIG. 10) is received in handle body second end axial bore 230 so that detent 258 is biased into engagement with main body first end hub 248. Detent 258 may be formed from a pin 260 and spring 262. However, it should be understood that other suitable detent devices may be used.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to these embodiments since modifications can be made. For example, the detent mechanism shown in the various embodiments may also be included in the second pivot joint to prevent tang 118 from moving freely. In particular, detent 58 in FIGS. 1-4 may be placed in a recess formed in handle body second end 36 to provide a frictional engagement with main body first end yoke 48. Likewise, the detent of any other embodiment may be mixed and matched to provide a detent mechanism in one or both joints. Additionally, while handle 12 in FIG. 4 is shown being axially fixed and rotatable with respect to handle body 14, a detent (not shown) can be positioned intermediate handle 12 and handle body 14 to allow the handle to be rotationally fixed to handle body 14. Thus, tool 10, when the handle is locked, can be used as a nut driver. Therefore, it is contemplated that any and all such embodiments are included in the present invention as may fall within the scope and spirit of the claims.

What is claimed:

1. A wrench for engaging a workpiece, said wrench comprising:

a. a main body having
  i. a first end,
  ii. an opposite second end, and
  iii. an axis extending therebetween;

b. a handle body having
  i. a first end,
  ii. an opposite second end, and
  iii. an axis extending therebetween,
    wherein said handle body first end is pivotally coupled to said main body second end;

c. a handle axially fixed and rotatably coupled to said handle body second end; and d. a tang having
  i. a first end configured to releasably receive a tool,
  ii. an opposite second end that is pivotally coupled to said main body first end, and
  iii. an axis extending between said tang first end and said tang second end; and e. an elastic member coupled said tang second end and said main body second end.

2. The wrench of claim 1, wherein a. said handle body first end defines one of a first yoke and a first hub;

b. said main body second end defines the other of said first yoke and said first hub;

c. said first yoke and said first hub are rotatably coupled to each other by a fastener thereby forming a first pivot.

3. The wrench of claim 2, wherein a. said main body first end defines one of a second yoke and a second hub;

b. said tang second end defines the other of said second yoke and said second hub;

c. said second yoke and said second hub are rotatably coupled to each other by a fastener thereby forming a second pivot.

4. The wrench of claim 3, wherein a. said handle pivots with respect to said main body on a plane common to said handle body axis and said main body axis; and b. said tang pivots with respect to said main body so that said tang axis moves on said common plane.

5. The wrench of claim 1, wherein said handle is axially fixed and rotatably received on said handle body second end by a fastener.

6. The wrench of claim 5, wherein said fastener comprises a pin and a cap nut that is press fitted to one end of said pin.

7. A wrench for engaging a workpiece, said wrench comprising:

a. a main body having a first end, an opposite second end, and an axis extending therebetween;

b. a handle body having a first end, an opposite second end, and an axis extending therebetween, wherein said handle body first end is pivotally coupled to said main body second end;

c. a handle axially fixed and rotatably coupled to said handle body second end;

d. a tang having a first end configured to releasably receive a tool, an opposite second end that is pivotally coupled to said main body first end, and an axis extending between said tang first end and said tang second end;

e. an elastic member coupled to said tang second end and said main body second end.

8. The wrench of claim 7, wherein said handle is formed from a polymer material and contains an axial bore formed therethrough.

9. The wrench of claim 7, wherein said handle body axis, said main body axis and said tang axis move on a common plane when pivoted with respect to each other.

10. A wrench for engaging a workpiece, said wrench comprising:

a. a main body having a first end, a second end and a longitudinal axis extending therebetween;

b. a handle body having a longitudinal axis, wherein said handle body is pivotally coupled to said main body;

c. a handle axially fixed and rotatably coupled to said handle body;

d. a tang having a longitudinal axis, wherein said tang is pivotally coupled to said first end of said main body e. an elastic member coupled to said second end of said main body and said tang,
  wherein said handle body longitudinal axis, said main body longitudinal axis and said tang longitudinal axis are all positioned on a common plane and are maintained on said common plane as each is pivoted with respect to the others.

* * * * *

UNITED STATES PATENT AND TRADEMARK OFFICE

CERTIFICATE OF CORRECTION

PATENT NO. : 8,117,951 B2
APPLICATION NO. : 12/355221
DATED : February 21, 2012
INVENTOR(S) : Thomas J. Brobst It is certified that error appears in the above-identified patent and that said Letters Patent is hereby corrected as shown below:

Claim 1, column 5, line 28, please delete the word “and”.

Column 5, line 35, please insert the word --to-- after the word “coupled”.

Column 6, line 25, please insert the word --and-- after the phrase “tang second end,”.

Signed and Sealed this
Eighth Day of January, 2013

David J. Kappos

David J. Kappos
*Director of the United States Patent and Trademark Office*